United States Patent [19]

Spilker, Jr.

[11] 4,324,002

[45] Apr. 6, 1982

[54] DELAY-MODULATED RANDOM ENERGY INTELLIGENCE COMMUNICATION SYSTEM

[75] Inventor: James J. Spilker, Jr., Palo Alto, Calif.

[73] Assignee: Lockheed Missiles & Space Company, Inc., Sunnyvale, Calif.

[21] Appl. No.: 17,729

[22] Filed: Mar. 18, 1960

[51] Int. Cl.[3] ..... H04K 1/00

[52] U.S. Cl. ..... 455/27; 455/26; 375/2.1; 375/23; 332/9 R

[58] Field of Search ..... 332/68, 9, 9 R; 252/6.4, 6.8, 6.6; 329/145, 104; 375/2.1, 23, 58; 455/26, 27, 29, 59, 101; 179/15.55 T

[56] References Cited

U.S. PATENT DOCUMENTS

| | | | |
|---|---|---|---|
| 2,530,140 | 11/1950 | Atkinson | 375/2.1 |
| 2,565,504 | 8/1951 | Labin et al. | 375/23 |
| 2,829,346 | 4/1958 | Hughes et al. | 332/9 R |
| 2,923,882 | 2/1960 | Bradford | 332/23 |
| 2,972,046 | 2/1961 | Seaton | 332/68 |
| 3,150,374 | 9/1964 | Sunstein et al. | 179/15.55 T |

FOREIGN PATENT DOCUMENTS 663511 8/1938 Fed. Rep. of Germany .

*Primary Examiner*—Howard A. Birmiel
*Attorney, Agent, or Firm*—John J. Morrissey

EXEMPLARY CLAIM

1. An intelligence communication system comprising a transmitter and a receiver; said transmitter comprising non-periodic energy means for generating a carrier, means for effecting a change in the time or frequency domain of the carrier signal whereby a reference signal is generated, means for effecting a variable delay in said carrier signal in accordance with the intelligence to be communicated whereby a message signal is generated, and means for radiating the reference and message signals; said receiver comprising means for picking up the reference and message signals, means for effecting a change in the picked up signal which change is complementary with that caused by first said change effecting means, and means responsive to said picking up means and last said change effecting means for deriving the intelligence signal therefrom.

8 Claims, 4 Drawing Figures

DELAY-MODULATED RANDOM ENERGY INTELLIGENCE COMMUNICATION SYSTEM

This invention relates to means and methods of transmitting and receiving intelligence,. and more particularly to improved means and methods of transmitting and receiving intelligence using a non-periodic carrier signal which is delay-modulated by the intelligence to be communicated.

In accordance with the present invention, a new approach is taken to intelligence communication whereby relatively wide band non-periodic energy is employed as the carrier signal in place of the relatively narrow band periodic signals employed in presently known communication systems; also, the intelligence is incorporated into the transmitted signal by delay modulating the non-periodic carrier in accordance with the intelligence signal.

One of the important advantages of the use of non-periodic energy as a carrier signal for intelligence communication is that it permits the direct use of large energies which may appear in abundance in nature (ordinarily in random form) which were heretofore unavailable or undesirable for intelligence communication, because the energy could not practically be converted to the periodic form required in present day systems. In such situations the use of delay modulation of the non-periodic energy is most convenient and advantageous and is sometimes the only way in which modulation can practically be accomplished. However, the accurate demodulation of such delay modulated non-periodic energy offers considerable difficulties and can not accurately be accomplished by means of presently known demodulation techniques, or even by demodulation techniques applicable for demodulating amplitude-modulated or band-modulated random or semi-random energy.

Accordingly, it is the broad object of this invention to provide improved means and methods for transmitting and receiving intelligence in which non-periodic energy is used as the signal carrier and the intelligence is incorporated by delay-modulating the non-periodic carrier signal with the intelligence signal.

Another object of this invention is to provide improved means and methods for accurately demodulating a delay modulated non-periodic signal, even for large delay modulation deviations.

A further object of this invention is to provide a transmitting and receiving system for intelligence communication which permits random energy such as might freely appear in nature to be used as the carrier signal.

Still another object of this invention is to provide improved means and methods for transmitting and receiving intelligence which permit efficient exploitation of a large portion of the electromagnetic spectrum.

An additional object of this invention is to provide a transmitting and receiving system for intelligence communication which has a high immunity to jamming and can readily be adapted to provide a relatively high degree of secrecy.

In a typical embodiment of the present invention, the above objects are accomplished by means of a transmitting and receiving system in which a relatively wide band non-periodic carrier signal is delay-modulated by an intelligence signal in the transmitter and is radiated to the receiver along with the unmodulated non-periodic signal which is separated therefrom in the time or frequency domain. The receiver incorporates novel demodulation means for accurately reproducing the intelligence even in the presence of large amounts of interfering noise.

The specific nature of the invention, as well as other objects, uses and advantages thereof, will clearly appear from the following description and from the accompanying drawing in which.

Like numerals refer to like elements throughout the figures of the drawing.

Figure 1:
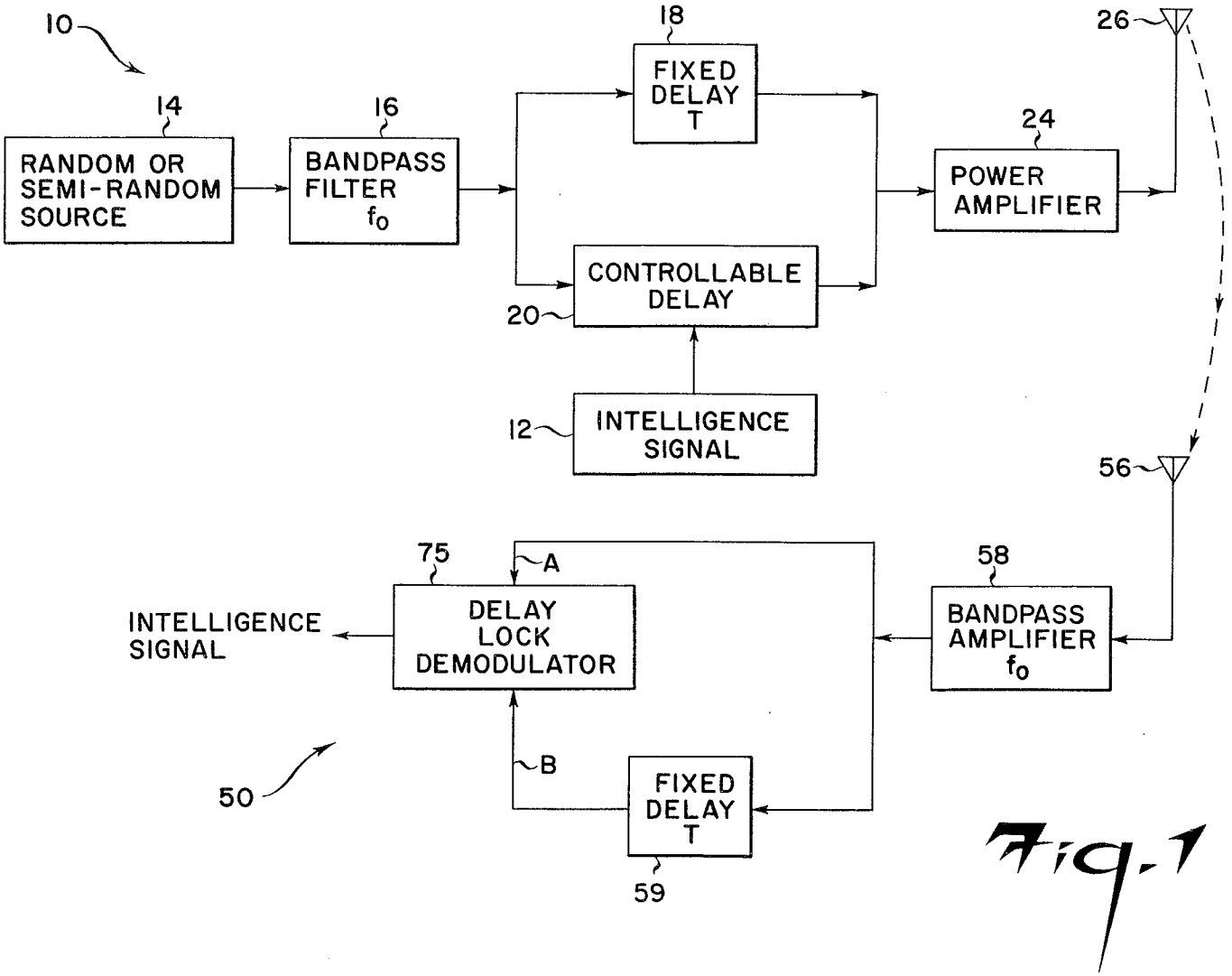
FIG. 1 is a block diagram of an embodiment of a transmitting and receiving system in accordance with the invention.

In FIG. 1 a transmitter 10 and a receiver 50 are shown. In the transmitter 10, a random or semi-random signal source 14 provides a signal which has some random characteristic associated with it. For example, the source 14 may provide a true random signal over a wide band obtained by amplifying thermal, shot or any other available random source, such as might freely be available in nature. Or, the signal from the source 14 may be a semi-random signal obtained by introducing some random variation into a periodic signal, such as by noise modulation thereof. Such random and semi-random signals will hereinafter be referred to as non-periodic signals.

The non-periodic signal obtained from the source 14 may be spread over a wide band and it is often desirable to restrict its bandwidth to a predetermined band of frequencies. This is accomplished by feeding the output of the source 14 to a bandpass filter 16 having a predetermined center frequency $f_o$ and a predetermined bandwidth. The bandwidth of the bandpass filter 16 is chosen at least ten times larger than the bandwidth of the intelligence signal 12 which is to be transmitted and such a bandwidth is ordinarily very much larger than that of conventional narrow band periodic communication systems. The designation of the non-periodic carrier bandwidth as relatively large in the specification and claims is intended to refer to a bandwidth chosen in this manner.

The output from the bandpass filter 16, which is a non-periodic signal centered at $f_o$ and having a bandwidth determined by the bandpass filter 16, is now divided into two portions. One portion is fed to a power amplifier 24 through a fixed delay 18 which delays this portion by a fixed amount T, i.e., delay 18 effects a change in the time domain of the non-periodic signal. The other portion is fed to the power amplifier 24 through a controllable delay 20 which delays this portion in accordance with an intelligence signal 12 applied to a control input **20*c* thereof, so as to produce a non-periodic signal delay modulated by the intelligence signal 12. The power amplifier 24 amplifies the two portions fed thereto and feeds them to an antenna 26 for radiation to the receiver 50. The radiated portion which has been delayed by the fixed amount T will hereinafter be referred to as the non-periodic reference signal, while the radiated portion which has been delay modulated in accordance with the intelligence signal 12 will hereinafter be referred to as the non-periodic message signal. The delay T provided by the fixed delay 18** is chosen sufficiently large so that the radiated non-periodic reference and message signals are substantially uncorrelated.

The controllable delay 20 for delay modulating the intelligence signal 12 may be provided in a variety of well known ways. One such way is shown in block form in FIG. 2, comprising a magnetic delay line 172, a current amplifier 177 feeding the control winding of the magnetic delay line 172, an adjustable d-c current source 179, and a constant power circuit 171 to which the output of the magnetic delay line 172 is fed. The signal to be delay modulated is fed to the magnetic delay line 172 at the signal input 20*a* and arrives at the output of the magnetic delay line 172 delay modulated in accordance with the signal applied to the control winding thereof from the current amplifier 177 to which is fed the intelligence signal 12. The adjustable d-c current source 179 controls the fixed delay provided by the magnetic delay line 172. The constant power circuit 171 is a form of automatic gain control and is for the purpose of removing any amplitude modulation which may be caused by delay modulation or any other amplitude variations which might previously have been introduced into the signal. The magnetic delay line 172 may be similar to the commercially available General Electric Magnetic Phase Modulator, while the constant power circuit 171 could be an automatic gain control circuit having its gain controlled by its power output or, in some cases, could be a "hard" type of limiter.

The non-periodic reference and message signals radiated from the transmitter 10 are picked up at the receiver 50 by an antenna 56 which feeds the two received signals to a bandpass amplifier 58 centered at $f_o$ and having a bandwidth sufficient to pass the two signals and the modulation components of the non-periodic message signal produced by delay modulation. A bandwidth of twice the bandwidth provided by the bandpass filter 16 is usually sufficient. The output signal from the bandpass amplifier 58 is divided into two portions, one portion being fed to the input A of a delay lock demodulator 75, and the other portion being fed to the other input B of the delay lock demodulator 75 through a fixed delay 58 which provides substantially the same delay T as the fixed delay 18 of the transmitter 10. Thus, the fixed delay 59 effects a change in the time domain of the output of the bandpass amplifier 58, which change is complementary with the change effected by fixed delay 18 in transmitter 10, such that the message and reference signals are restored to a time relationship which is a function of only the delay caused by controllable delay 20.

It will be understood that the non-periodic message signal which is delayed by the fixed delay 59 on its way to the input A of the delay lock demodulator 75, and the originally delayed non-periodic reference signal which is fed directly to the input B will now be correlated, since both signals have been delayed by T. The delay lock demodulator 75 is constructed and arranged to accurately derive the intelligence signal from these correlated non-periodic reference and message signals applied thereto, while substantially ignoring uncorrelated signals, such as noise and the out-of-time non-periodic message and reference signals which also appear at the inputs A and B.

The delay lock demodulator 75 shown in block form in FIG. 1 has been devised because it has been found that conventional types of correlation techniques will not satisfactorily demodulate delay-modulated non-periodic carrier signals. For example, if a conventional type of mixer multiplier were employed in place of the delay lock demodulator 75 in FIG. 1, it would be found that the output therefrom would be a signal proportional to the sine of the intelligence signal, rather than the intelligence signal itself. Since the sine of a signal is equal to the signal only for very small deviations thereof, it will be understood that such a mixer multiplier is inadequate for most purposes.

Figure 3:
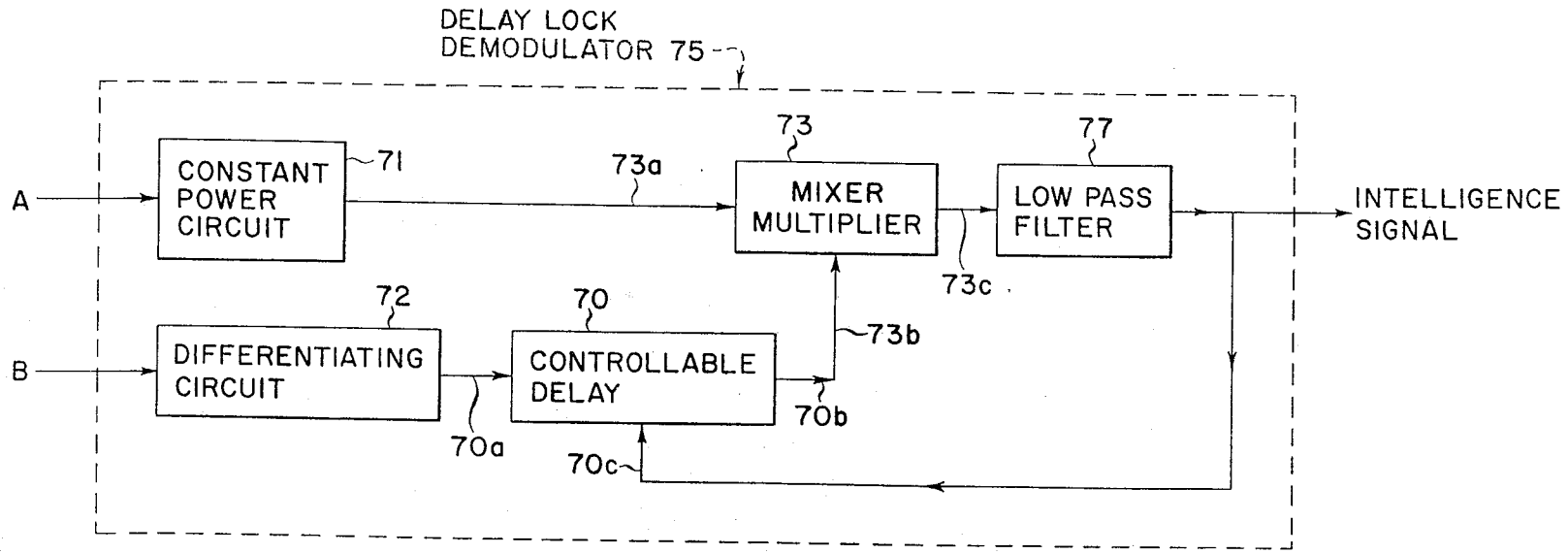
FIG. 3 is a block diagram of the delay lock demodulator of FIG. 1.

FIG. 3 is a block diagram illustrating an embodiment of the delay lock demodulator 75 which provides accurate demodulation of the correlated non-periodic reference and message signals applied to the respective inputs A and B thereof, even for large deviations of the intelligence signal. It will be seen in FIG. 3 that the delay lock demodulator 75 comprises a constant power circuit 71 to which the correlated non-periodic message signal is fed from input A, a differentiating circuit 72 to which the correlated non-periodic reference signal is fed from input B, a controllable delay 70 to which the output from the differentiating circuit 72 is fed, a mixer multiplier 73 having inputs 73*a* and 73*b* to which the outputs from the constant power circuit 71 and the controllable delay 70 are respectively fed for multiplication, and a low pass filter 77 to which the multiplied output from the mixer multiplier 73 is fed, the output of the low pass filter 77 being fed to the input 70*c* of the controllable delay 70 to control the delay provided thereby.

Figure 2:
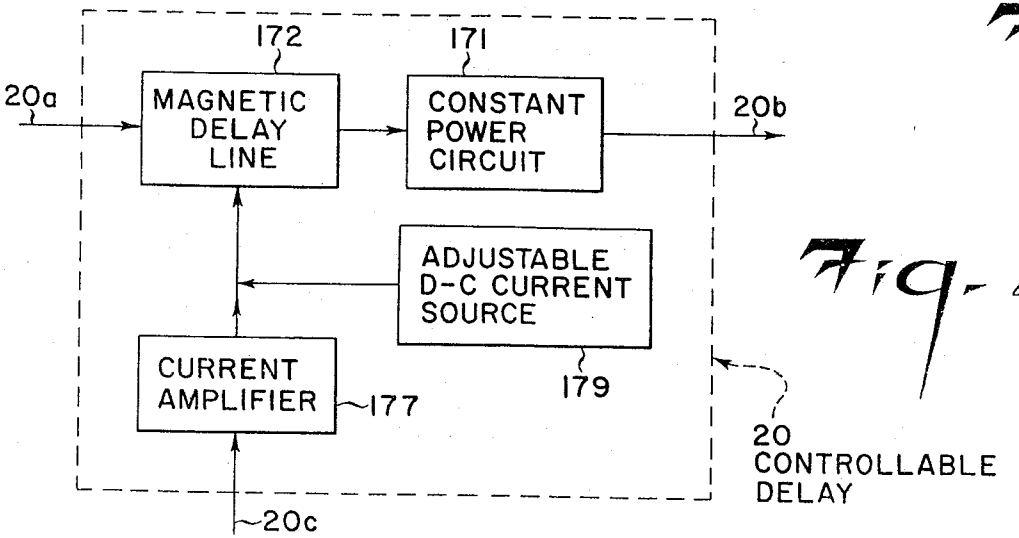
FIG. 2 is a block diagram of the controllable delay of FIG. 1.

The controllable delay 70 in the delay lock demodulator 75 of FIG. 3 may be the same as the controllable delay 20 shown in FIG. 2, the terminals 70*a*, 70*b* and 70*c* respectively corresponding to the terminals 20*a*, 20*b* and 20*c*. Also, the constant power circuit 71 in FIG. 3 may be the same as the constant power circuit 171 of FIG. 2. The differentiating circuit 72 serves to produce an output signal which is the derivative of the signal applied thereto from input B, and may be of a conventional type, such as a simple R-C differentiating circuit.

The mixer multiplier 73 is adapted to produce a signal at its output 73*c* which is the product of the two signals applied to its inputs 73*a* and 73*b* from the constant power circuit 71 and the controllable delay 70, respectively. Because the intelligence signal 12 is ordinarily of relatively low frequency, it is only important that the low frequency product terms be accurately obtained. The mixer multiplier 73 may be provided in a variety of well known forms. One type of mixer multiplier which could be suitably used for the mixer multiplier 73 of FIG. 3 is shown in "Communication Theory", Willis Jackson, Academic Press, pp. 200–202.

The low pass filter 77 is designed so that its net effect is to permit the passage of the important spectral components of the intelligence signal obtained at the output of the mixer multiplier 73, while substantially removing the perturbing terms having spectral components outside of the important frequency range of the intelligence signal. For most cases, the filter 77 need only be a simple type of low pass filter with a cut-off frequency determined by the important frequency range of the intelligence signal.

The operation of the delay lock demodulator 75 will now be understood from the following considerations.

The correlated non-periodic message and reference signals are fed to the inputs A and B, respectively, as described previously. The two signals are correlated—that is, returned to the same time basis and derived from the same non-periodic signal—but the message signal is delay modulated by the intelligence signal, while the reference signal is unmodulated. The non-periodic message signal passes through the constant power circuit 71 to the input 73*a* of the mixer multiplier 73 where it is multiplied with the differentiated non-periodic reference signal which is delayed by the controllable delay 70, the amount of delay being controlled by the output from the low pass filter 77 which is fed to the control input 70*c* of the controllable delay 70. The constant power circuit 71 removes amplitude modulated noise or other unwanted amplitude variations which may be present in the non-periodic message signal.

If the non-periodic message signal is now designated as $$S(t-\tau) \tag{1}$$

where $\tau$ is the intelligence signal, it will be understood that the differentiated and delayed non-periodic reference signal may then be designated as $$\frac{dS(t-\hat{\tau})}{dt} \tag{2}$$

where $\hat{\tau}$ is the delay provided by the controllable delay 70 in accordance with the output from the filter 77. The product of these two signals formed at the output 73*c* of the mixer multiplier 73 may then be written as $$S(t+\tau)\left[\frac{dS(t-\hat{\tau})}{dt}\right] \tag{3}$$

Since the low pass filter 77 may be considered as effectively averaging the signal applied thereto from the output of the mixer multiplier 73, the output of the filter 77 will effectively be a signal proportional to the average $A_v$ of the above product, which can be shown to be mathematically expressable as $$Av = \frac{dR_s(\sigma)}{d\sigma}\bigg|_{\sigma=\tau-\hat{\tau}} \cong K(\tau-\hat{\tau}) \tag{4}$$

where $R_s(\sigma)$ is the autocorrelation function of $S_1(t)$ and $(\tau-\hat{\tau})$ is small. It can thus be seen that the magnitude of the instantaneous output of the filter 77, which is proportional to the average $A_v$ expressed by equation (4), will be directly proportional to the instantaneous value of the difference $(\tau-\hat{\tau})$.

The controllable delay 70 is constructed and arranged so that the output of the filter 77 which is fed to the control input 70*c* thereof, causes the instantaneous delay $\hat{\tau}$ provided by the controllable delay 70 to be changed in a direction which acts to reduce the difference $(\tau-\hat{\tau})$. The loop gain is chosen so that the difference $(\tau-\hat{\tau})$ is sufficiently small for the maximum deviation of $\tau$ expected to achieve the desired accuracy of representation of $\tau$ in the output from the mixer multiplier 73, but not so large as to reduce the output of the filter 77 below a useable level. Such a choice of loop gain in the delay lock demodulator 75 is analogous to the choice of the amount of feedback which should be provided in an amplifier having a limited range of linear operation in order to permit the faithful amplification of large input signals. In both cases the result of the feedback is to increase the dynamic range of linear operation of the systems.

In operating the receiver 50 with the delay lock demodulator 75 shown in FIG. 3, it is necessary to first "lock-in" the delay lock demodulator 75 by adjusting the fixed delay provided by the controllable delay 70 so that the difference $(\tau-\hat{\tau})$ is small. Ordinarily, a condition where $(\tau-\hat{\tau})$ is less than $(1)/(2\pi f_o)$ is sufficient, $f_o$ being the center frequency of the bandpass filter 16. This adjustment may be accomplished by means of the adjustable d-c current source 179 of the controllable delay illustrated in FIG. 2. Those skilled in the art will appreciate that if so desired, suitable electronic circuitry could be employed for making this adjustment automatic.

Now summarizing the operation of the transmitting and receiving system of FIG. 1, it will be remembered that in the transmitter 10 the band restricted non-periodic signal obtained from the bandpass filter 16 is divided into two portions, one portion being delayed by a fixed delay T upon passage through the fixed delay 18 to form a non-periodic reference signal, and the other portion being delay modulated by an intelligence signal 12 upon passage through the controllable delay 20 to form a non-periodic message signal. The non-periodic message and reference signals are fed to a power amplifier 24 where they are amplified to a suitable level and passed to an antenna 26 for radiation to the receiver 50.

At the receiver 50, the non-periodic message and reference signals are picked up by the antenna 56, and amplified by the bandpass amplifier 58. The output of the bandpass amplifier 58 is divided into two portions, one portion being fed directly to the input A of the delay lock demodulator 75 and the other portion being fed to the input B of the delay lock demodulator 75 through a fixed delay 59 providing substantially the same delay T as the fixed delay 18 in the transmitter 10. Correlated non-periodic message and reference signals are thereby applied to the inputs A and B of the delay lock demodulator 75 which accurately derives the intelligence signal therefrom. As previously described, the delay lock demodulator 75 acts essentially as a mixer multiplier having a large dynamic range which accurately demodulates the two correlated signals applied thereto, even for large delay modulation deviations.

Various important features of the system of FIG. 1 will now become evident. First, because detection is obtained by demodulating correlated signals and then effectively averaging, it will be understood that detection of the intelligence signal is possible even in the presence of large amounts of interfering noise or jamming signals, since uncorrelated signals tend to average out to zero. Secondly because both the non-periodic message and reference signals transmitted receive the same doppler shift (which may result from relative velocity between the transmitter and receiver) doppler will have no effect on system operation.

Another feature of the system which can be of importance in some situations is that the system permits any sort of non-periodic energy, such as might appear in nature, to be used as the carrier, and there is no need to generate large amounts of periodic energy which is sometimes most difficult to accomplish, particularly at very high microwave frequencies. Theoretically, periodic signals could be employed in the system of FIG. 1, but the result would not be as advantageous as when using a non-periodic signal, because periodic signals will correlate to some extent with a wide variety of signals and thus will make the system more susceptible to noise and jamming. However, it is possible that there may be some benefit in using periodic signals, particularly with the novel delay lock demodulator described, and the present invention is intended to include the use of periodic signals.

The use of a non-periodic signal has the further advantage that a relatively wide band random signal can conveniently be obtained by suitable choice of the bandwidth of the bandpass filter 16. The wide band non-periodic message and reference signals may then be received with small signal-to-noise ratios and yet, be demodulated with high signal-to-noise ratios. Also, a system employing wide band non-periodic transmitted signals is most difficult to jam, because of the wide range of jamming frequencies which must be provided and the small possibility that they will be sufficiently correlated to affect system operation. Still further, it will be realized that an unwanted listener will be unable to interpret the transmitted signals without knowing the delay T provided by the fixed delay 18.

Another feature of the system of FIG. 1 is that because the intelligence signal can be detected even in the presence of large amounts of noise or other interfering signals, it becomes possible to operate one or more such systems in the same or overlapping bands, or in the presence of standard periodic carrier communication systems. It will be appreciated, therefore, that a given portion of the spectrum may be used at least as efficiently when employing wide band random energy as the carrier as when conventional narrow channel periodic systems are employed.

In the system of FIG. 1 separation between the two transmitted signals is provided by inserting a fixed delay into one of the two signals. It is also possible to separate the two transmitted signals by heterodyning one of the signals to a non-overlapping frequency band. Such a system is illustrated in FIG. 4.

Figure 4:
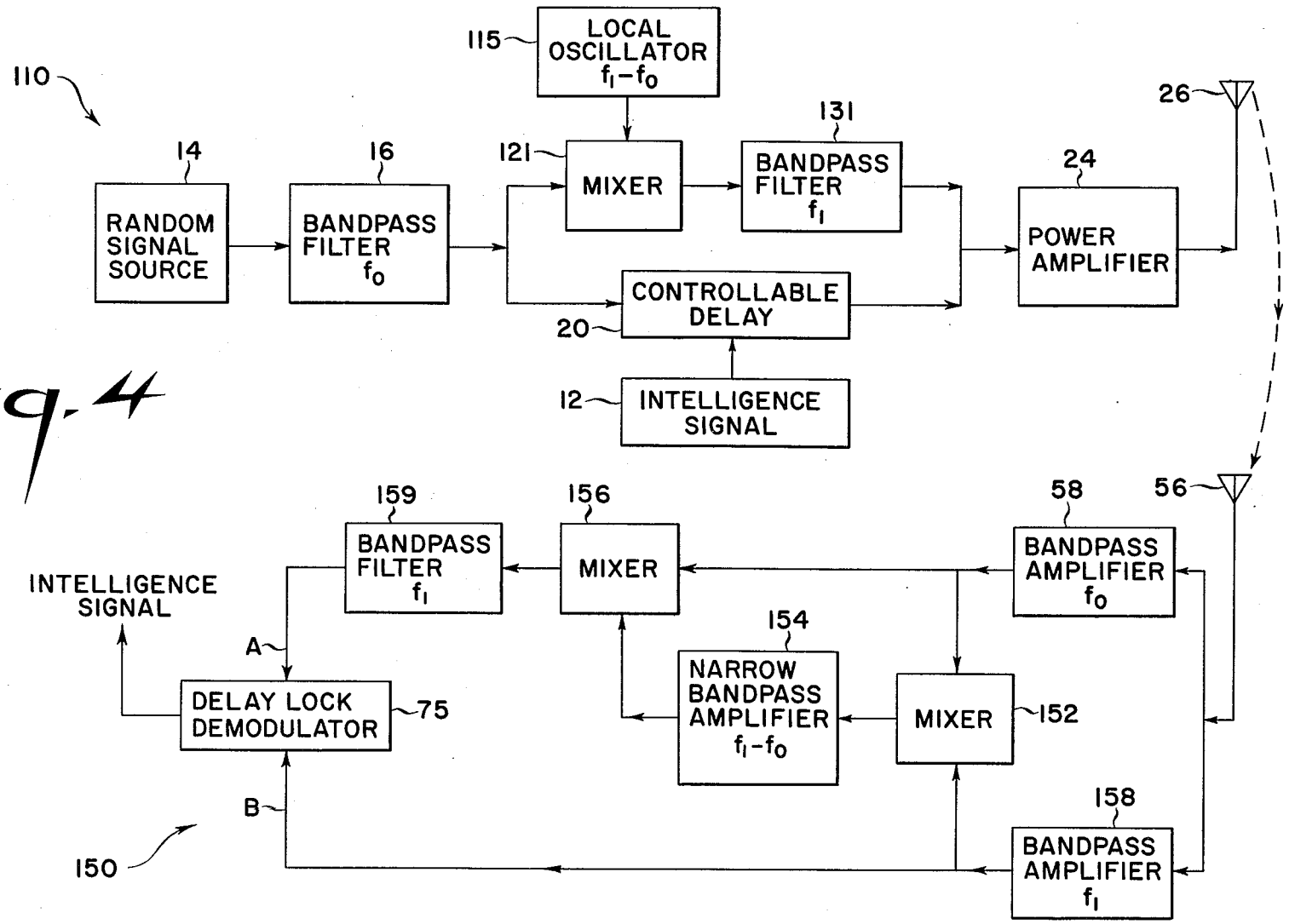
FIG. 4 is a block diagram of another embodiment of a transmitting and receiving system in accordance with the invention.

As in the system of FIG. 1, the restricted band non-periodic signal at the output of the bandpass filter 16 in the transmitter 110 of the system of FIG. 4 is divided into two portions. Also as in FIG. 1, one portion is passed through the controllable delay 20 where it is delay modulated by the intelligence signal 12 and then fed to the power amplifier 24. The other portion, however, instead of being fed to the fixed delay 18 as in FIG. 1, is heterodyned in a mixer 121 with a sinusoidal signal of frequency $f_1-f_o$ obtained from a local oscillator 115. The heterodyned output from the mixer 121 is fed to the power amplifier 24 through a bandpass filter 131 centered at the frequency $f_1$ and having a bandwidth sufficient to pass only the heterodyned sum of the mixer output. Thus it is seen that the coaction of oscillator 115 and mixer 121 effects a change in the frequency domain of the random signal.

Radiated to the receiver 150, therefore, will be two signals: a delay modulated non-periodic signal centered at the frequency $f_o$ which corresponds to the non-periodic message signal of the system of FIG. 1, and an unmodulated non-periodic signal centered at the frequency $f_1$ in a non-overlapping frequency band which corresponds to the non-periodic reference signal of the system of FIG. 1. At the receiver 150 these two signals are separated, brought to the same frequency band and then fed to the inputs A and B of the delay lock demodulator 75 for demodulation as will now be described.

The transmitted non-periodic message and reference signals are picked up at the receiver 150 by the antenna 56 and fed to the bandpass amplifiers 58 and 158 which separate the two signals from one another. The bandpass amplifier 58 is centered at the frequency $f_o$ and has a bandwidth sufficient to pass the non-periodic message signal and its delay modulation components, but not so wide as to pass the non-periodic reference signal. Conversely, the amplifier 158 is centered at the frequency $f_1$ and has a bandwidth sufficient to pass the non-periodic reference signal, but not so wide as to pass the non-periodic message signal. Thus, the output from the bandpass amplifier 58 will contain only the non-periodic message signal centered at $f_o$ and the output from the bandpass amplifier 158 will contain only the non-periodic reference signal centered at $f_1$.

The outputs of each of the bandpass amplifiers 58 and 158 are divided into two portions, one portion of each being fed to the input of a mixer 152 where they are heterodyned to produce at the output of the mixer 152 a signal having a frequency component corresponding to the difference $f_1-f_o$ of the center frequencies of the non-periodic message and reference signals. The output signal from the mixer 152 is fed to a narrow bandpass amplifier 154 centered at the frequency $f_1-f_o$ and having a very narrow bandwidth which passes substantially only the frequency component $f_1-f_o$ in the mixer output. This signal at the frequency $f_1-f_o$ appearing at the output of the amplifier 154 is now fed to a mixer 156 where it is mixed with the other portion of the non-periodic message signal output from the bandpass amplifier 58 in order to translate the non-periodic message signal to the band centered at $f_1$. The output of the mixer 156 is passed to a bandpass filter 159 centered at the frequency $f_1$ and having a bandwidth sufficient to pass only the heterodyned sum from the mixer 152, which is the non-periodic message signal in the band centered at $f_1$.

The non-periodic message signal at the output of the bandpass amplifier 159 and the non-periodic reference signal at the output of the bandpass amplifier 158 will thus both be in the same band centered at $f_1$ and these signals are fed to the inputs A and B, respectively, of the delay lock demodulator 75 for demodulation, which takes place to reproduce the intelligence signal as described previously. Thus the mixer 152, bandpass amplifier 154, mixer 156, and filter 159 cooperate to effect a change in the frequency domain of the output of amplifier 58 which change is complementary with that effected by oscillator 115 and mixer 121 in transmitter 110. In order to "lock-in" the delay lock demodulator for the system of FIG. 4, the difference $(\tau-\hat{\tau})$ should now ordinarily be less than $(1)/(2\pi f_1)$, since the two correlated signals are now in bands centered at $f_1$.

It will be noted that the system of FIG. 4 is considerably more complex than that of FIG. 1, but offers the advantage of providing a higher signal-to-noise ratio. This is because the uncorrelated out-of-time non-periodic message and reference signals in the system of FIG. 1 are present at the inputs A and B to the delay lock demodulator 75 along with the correlated non-periodic message and reference signals from which the intelligence signal is derived. The presence of these uncorrelated signals inherently introduces noise which reduces the signal-to-noise ratio of the system. In the system of FIG. 4, on the other hand, only the non-periodic message and reference signals which have been brought to the same band are fed to the inputs A and B or the delay lock demodulator 75, so that the noise present will be significantly reduced, thereby improving the signal-to-noise ratio. Where the signal-to-noise ratio is a primary requirement, the use of the system of FIG. 4 may well be justified, even though it is somewhat more complex than that of FIG. 1.

It will be realized in connection with the system of FIG. 1 that because the transmitted non-periodic message and reference signals are separable into two non-overlapping frequency bands, an unwanted listener could conceivably separate the two signals and derive the intelligence signal therefrom. To overcome this possibility and provide greater secrecy, one of the transmitted signals could be passed through a distortion network (such as a filter) which would then make the transmitted signals unintelligible to one not knowing the distortion which has been introduced. In the receiver, an inverted distortion network could then be employed to return the distorted signal to its initial form so that it could be demodulated as described in connection with the system of FIG. 4.

It is to be understood in connection with the systems described herein the the electronic circuitry and devices designated in block form in the figures of the drawing, except for the novel delay lock demodulator 75, are all of a type which can readily be provided by those skilled in the art. In regard to the novel delay lock demodulator 75 shown in FIG. 3, it will be noted that the electronic circuitry and devices shown in block form are all readily providable in a form which will permit the construction of a delay lock demodulator 75 which operates as described herein. Those skilled in the art, therefore, should have no difficulty in practicing this invention.

It is also to be understood that the invention is not limited to the embodiments described and illustrated herein, since many modifications and variations may be made in the construction and arrangement thereof without departing from the scope of the invention as defined in the appended claims.

I claim as my invention:

1. An intelligence communication system comprising a transmitter and a receiver; said transmitter comprising non-periodic energy means for generating a carrier, means for effecting a change in the time or frequency domain of the carrier signal whereby a reference signal is generated, means for effecting a variable delay in said carrier signal in accordance with the intelligence to be communicated whereby a message signal is generated, and means for radiating the reference and message signals; said receiver comprising means for picking up the reference and message signals, means for effecting a change in the picked up signal which change is complementary with that caused by first said change effecting means, and means responsive to said picking up means and last said change effecting means for deriving the intelligence signal therefrom.

2. The invention of claim 1 in which said carrier generating means comprises a source of wide band energy and means for passing a relatively large frequency band of the output of said source.

3. The invention of claim 2 in which first said change effecting means comprises means for delaying the carrier for a preselected time and last said change effecting means comprises means for delaying the picked up signal by the same preselected time.

4. The invention of claim 2 in which first said change effecting means comprises an oscillator, means for heterodyning the output of said oscillator with the output of said carrier generating means, and means for limiting the output of said heterodyning means to a frequency band different from the frequency band passed by said relatively large frequency band passing means, and in which said second change effecting means comprises means for restoring the picked up signal to a band of frequencies equal to that passed by said relatively large frequency band passing means and means for heterodyning the output of said restoring means with the output of said pickup means.

5. A detector for a signal having a carrier signal and an intelligence signal which is delayed from the carrier signal by a time duration proportional to the intelligence to be detected comprising means for differentiating the carrier signal, means for controllably delaying the differentiated signal, means for deriving the product of last said delaying means and the carrier signal, a low pass filter responsive to said product deriving means, and means for feeding back the output of said low pass filter to said controllable delaying means, said controllable delaying means being adapted to cause an increase in the maximum delay excursion as the output of said filter decreases.

6. The invention of claim 5 having means for effecting a fixed delay which is connected for additive cooperation with said controllable delaying means.

7. An intelligence communications system comprising a transmitter and a receiver; said transmitter comprising means for generating a non-periodic energy signal, means for converting said non-periodic energy signal to an output signal having a time delayed reference carrier signal and a message signal which is delayed with respect to the reference carrier signal by a time duration proportional to an applied intelligence signal, and means for radiating the reference carrier signal and message signals from the same antenna; said receiver comprising means for detecting said output signal radiated from said transmitter, means for differentiating the carrier signal of said output signal, means for controllably delaying the differentiated carrier signal, means for deriving a product of the output of said controllable delaying means and carrier signal, a low pass filter responsive to said product deriving means, and means for feeding back a portion of the output of said low pass filter to said controllable delaying means, said controllable delaying means being adapted to cause an increase in the maximum delayed excursion as the output of said filter decreases.

8. A delay modulated random energy intelligence communication system, including a transmitter comprising means for generating an output signal from a non-periodic energy signal, said output signal having a carrier signal and a message signal which has a time delay different from that of the carrier signal by a time duration proportional to the amplitude and frequency modulation of an applied intelligence signal, and means for radiating the carrier and message signals from an antenna simultaneously; a receiver comprising means for picking up the carrier and message signals, means for differentiating the carrier signal, means for controllably delaying the differentiated signal, means for deriving the product of the output of said controllable delaying means and the carrier signal, a low pass filter responsive to said product deriving means, and means for feeding back a portion of the output of said low pass filter to said controllable delaying means, said controllable delaying means being adapted to cause an increase in the maximum delayed excursion as the output of said filter decreases, and means for effecting a fixed delay which is connected for additive cooperation with said controllable delaying means.

* * * * *